US010617192B2

(12) United States Patent
Tan et al.

(10) Patent No.: US 10,617,192 B2
(45) Date of Patent: Apr. 14, 2020

(54) APPARATUS FOR APPLYING AND RECYCLING NAIL POLISH POWDER AND METHOD OF USE

(71) Applicant: Glam and Glits Nail Design, Inc., Bakersfield, CA (US)

(72) Inventors: Ana Katrina Tan, Bakersfield, CA (US); Khoa Duong, Bakersfield, CA (US)

(73) Assignee: Glam and Glits Nail Design, Inc., Bakersfield, CA (US)

( * ) Notice: Subject to any disclaimer, the term of this patent is extended or adjusted under 35 U.S.C. 154(b) by 241 days.

(21) Appl. No.: 15/607,292

(22) Filed: May 26, 2017

(65) Prior Publication Data

US 2018/0192759 A1 Jul. 12, 2018

Related U.S. Application Data

(60) Provisional application No. 62/443,386, filed on Jan. 6, 2017.

(51) Int. Cl.

| | |
|---|---|
| ***A45D 29/00*** | (2006.01) |
| ***A45D 29/22*** | (2006.01) |
| ***A45D 33/00*** | (2006.01) |

(52) U.S. Cl.

CPC ..... *A45D 29/22* (2013.01); *A45D 33/00* (2013.01)

(58) Field of Classification Search

CPC ..... A45D 29/22; A45D 29/00; A45D 29/20; A45D 29/18; A45D 2031/005; A45D 33/003; A45D 2200/05; A45D 2200/058

See application file for complete search history.

(56) References Cited

U.S. PATENT DOCUMENTS

| | | | | |
|---|---|---|---|---|
| 2,291,125 | A | 7/1942 | Wilkinson | |
| 2,662,534 | A | 12/1953 | Charles | |
| 4,524,789 | A | 6/1985 | Sazdanoff | |
| 4,696,316 | A | 9/1987 | Stanley | |
| 4,915,331 | A | 4/1990 | Becker et al. | |
| 5,027,839 | A | 7/1991 | Appell | |
| 5,139,036 | A | 8/1992 | Pickard | |
| 8,061,365 | B2 | 11/2011 | Rehkemper et al. | |
| 9,179,753 | B2 | 11/2015 | Huynh | |
| 9,314,083 | B2 | 4/2016 | Shaul | |
| D777,981 | S | 1/2017 | Oh | |
| 2005/0255061 | A1 | 11/2005 | Park | |
| 2006/0260628 | A1 | 11/2006 | Chan | |
| 2008/0173321 | A1* | 7/2008 | Le | A45D 29/00 132/200 |
| 2008/0185012 | A1 | 8/2008 | Tran | |
| 2009/0260647 | A1 | 10/2009 | Ionis et al. | |
| 2016/0345708 | A1 | 12/2016 | Walia et al. | |

FOREIGN PATENT DOCUMENTS

| | | | | |
|---|---|---|---|---|
| WO | WO2013043601 | * | 3/2013 | A45D 29/20 |
| WO | WO2017143123 | * | 8/2017 | A45D 34/04 |

* cited by examiner

*Primary Examiner* — Rachel R Steitz
*Assistant Examiner* — Brianne E Kalach
(74) *Attorney, Agent, or Firm* — Lapple Ubell IP Law, LLP; Matthew C. Lapple

(57) ABSTRACT

Embodiments of the present invention relate to a nail powder application and recycling apparatus and method of use.

22 Claims, 12 Drawing Sheets

APPARATUS FOR APPLYING AND RECYCLING NAIL POLISH POWDER AND METHOD OF USE

CROSS REFERENCE TO RELATED APPLICATIONS

The subject application claims priority to U.S. Provisional Patent Application Ser. No. 62/443,386, filed on Jan. 6, 2017, which application is incorporated herein in its entirety by this reference thereto.

FIELD OF THE INVENTION

Embodiments of the present invention relate to an apparatus and method for hygienically applying acrylic powder, or other powder, to fingernails or toenails, while minimizing waste by collecting and recycling fallen powder in a safe and hygienic manner.

DESCRIPTION OF RELATED ART

The use of nail polish to color and increase the aesthetic appeal of one's nails is a well-known and popular practice. Although many individuals purchase and apply their own nail polish, many others prefer to obtain professional manicures and pedicures. In the United States, the professional nail salon industry is approximately an 8.5 billion-dollar-a-year industry.

At a nail salon, a professional manicurist can perform a number of different nail treatments and use products that are not otherwise available to the home user. In order to maintain a sanitary and hygienic environment, the procedures and conditions of nail salons are normally regulated by state law and regulations, typically promulgated and enforced by a state board of health or a state board of cosmetology.

One nail treatment that is gaining in popularity is the use of powder coatings. Such powder coatings can be applied to a client's natural nails, or to an adhered false nail. These powder coatings may be a form of acrylic powder, but the present disclosure is not limited with respect to the exact composition of the power to be applied. These nail powders are often referred to as "dipping powder" or simply "dip powder." Herein, these nail powders will be referred to as "dipping powder." "dip powder" or "nail powder."

Dip powder is typically marketed and sold in cosmetics jars such as, for example, the KIARA SKY® line of Dip Powder, sold by Glam and Glits Nail Design, Inc. Each jar contains approximately one fluid ounce of powder and sells for a retail price of $14.99. In use, as described below, only a very small amount of dip powder is typically used per nail (or per 10 nails). As such, within a one fluid ounce jar of dip powder, there are approximately 100 individual applications. Assuming a client wants application of the same color on all ten finger nails (or toenails), a single jar of dip powder will be used on approximately 10-15 different clients, depending on the length of each client's nails to which the powder will be applied. If a client desires different colors on some of their nails, this number will be even greater, as less powder is used per client.

Currently, dip powder is applied generally using the following steps, when applying it to a finger nail or toe nail to which dip powder has not previously been applied. First, a professional manicurist thoroughly washes both her own hands, and the hands (or feet) of the client to which the dip powder is to be applied. Second, for each nail to which the dip powder will be applied, the professional manicurist uses a cuticle pusher tool to push back the cuticle of the nail. Third, the professional manicurist uses an electric nail file or regular nail file to remove the shine from the nail. This typically results in a quantity of dust, which is removed from the nail by use of a brush or wipe. Fourth, the professional manicurist applies a clear liquid bonding agent to the whole nail, typically using a 10 mm nylon nail polish brush. This clear liquid bonding agent is commonly Ethyl acetate, which is an organic compound used to prepare the nail and ensure all subsequent layers stick easily and stay put for a tight seal. Fifth, the professional manicurist applies a clear liquid base glaze to about three-quarters of the nail. This base glaze has adhesive properties from synthetic resin that allows the dip powder to stick and stay on the area to which it is applied for long lasting wear. The liquid base glaze works with the bond to keep the subsequent glue-like substance of later layers off of the client's actual nail, while allowing the subsequent layers to harden strong on the nail. Sixth, the professional manicurist dips the client's whole nail, and in actuality, most of the first digit of the client's finger, into a quantity of dip powder. This first application of dip powder is normally a "neutral" or "natural" color. This step is performed to prevent highly pigmented colors of dip powder from tinting the nail, and also to create strength in the nail tip. This is normally done immediately, while the clear liquid base is still wet. A layer of the dip powder will stick to the still-wet clear liquid base on the client's nail. Of course, a layer of the dip powder will also stick to the skin of the client's finger. The professional manicurist also normally taps, gently shakes, or brushes the client's finger to remove excess powder from the finger and finger nail. Seventh, the professional manicurist applies another coat of clear liquid base to the nail. This coat is typically put over the entire nail. Eighth, while the second coat of clear liquid base is still wet, the professional manicurist dips the client's whole nail, and most of the first digit of the client's finger, into a quantity of dip powder. This second application of acrylic powder polish is normally the final color that has been selected by the client as her nail color. Again, the professional manicurist taps, gently shakes, or brushes the client's finger to remove excess powder. Ninth, the professional manicurist applies another coat of clear liquid base to the nail. Tenth, while the third coat of clear liquid base is still wet, the professional manicurist dips the client's whole nail, and most of the first digit of the client's finger, into a quantity of dip powder. This third application of dip powder is normally a second application of powder in the final color that has been selected by the client, although it could be a different color, if desired. Eleventh, the professional manicurist applies another coat of clear liquid base to the nail. This coat is allowed to air dry. Twelfth, the professional manicurist applies a clear liquid sealant, which is used as a hardener for the powder, and to seal all previous layers together so the nail can be drilled, filed, and buffed. Thirteenth, the professional manicurist optionally files and shapes the nail. Fourteenth, the professional manicurist drills and/or buffs the nail surface. Fourteenth, the client should wash her hands. Fifteenth, the professional manicurist applies another coat of clear liquid sealant to seal, harden and protect the applied color dip powder, and then wipes the nail clean. Sixteenth, the professional manicurist quickly applies a clear liquid top coat, which causes polymerization to create complex bonds that in turn strengthen the below layers and add desired shine to the client's nails. The clear liquid top coat is allowed to air dry. Seventeenth, the professional manicurist applies another layer of clear liquid top coat, which is again allowed to air dry. Eighteenth, optionally, the professional manicurist applies an oil or lotion to the cuticle.

The above-described process can, if performed incorrectly, be unsanitary and unhygienic. If the professional manicurist or the client fail to wash their hands as directed, or fail to adequately and completely wash their hands, germs and other contaminants can be transferred into the jar or cup of dip powder. Further, if a client has any cuts, sores, or other breaks in the skin of the cuticle of the nail, or the skin of the finger, serious and dangerous blood-borne pathogens can be transferred from the client to the jar or cup of dip powder. Moreover, if the professional manicurist dips the client's fingers directly into the original jar of dip powder, the entire one fluid ounce jar can become contaminated with germs, skin cells, blood-borne pathogens, or other contaminants. If such contamination occurs, the professional manicurist should dispose of the entire jar. If the professional manicurist fails to do so, then any subsequent clients who use powder from that jar—or have their fingers dipped directly into that jar—may be exposed to those germs, skin cells, blood-borne pathogens, or other contaminants.

The above-described process can also be performed in a sanitary and hygienic manner, by pouring a separate quantity of acrylic powder into a cup, and using one cup for each color of dip powder, and using clean or new cups for each client. Currently, a number of nail salons use small disposable plastic cups, such as those commonly provided by fast-food restaurants for ketchup, sauces or salsa. While this has the benefit of avoiding direct dipping into the original jar of dip powder, and therefore avoids direct contamination of the entire jar of dip powder, this approach has a number of drawbacks. First, it can be wasteful of expensive dip powder. Typically, the professional manicurist must scoop or pour a quantity of acrylic powder into the disposable cup. This can result in spillage. Also, given the size and shape of the cups, the professional manicurist often still pours or scoops significantly more powder than needed into the disposable cup. Assuming that this excess is disposed of, this excess is wasted. Second, it can be wasteful of the professional manicurist's time. If the manicurist pours the powder while the client is waiting for services, this uses the professional manicurist's time in an unproductive manner, and further slows down the manicure, which can result in client dissatisfaction. Alternatively, if the manicurist prepares a large number of disposable cups containing a variety of colors of dip powder in advance, this is time consuming and requires "after-hours" work that is not directly related to providing client services that generate revenue. Further, if pre-poured cups are prepared and stored, this takes up storage space in the nail salon. Moreover, if the pre-poured cups are misplaced, lost or disordered, that can also slow down client service and result in wastage of powder. Third, using disposable restaurant sauce cups for the process can create an unprofessional image or impression on clients. One of the selling points of professional nail salons is that a manicure is an affordable luxury. Accordingly, using disposable plastic restaurant sauce cups—or an equivalently cheap and disposable solution—will interfere with the client's impression of the manicure services as a luxury.

Other nail salons use small glass cups in place of the plastic restaurant cups. While this presents a somewhat more luxurious image, it has all of the other drawbacks as the use of plastic cups.

Other than using plastic restaurant cups or glass cups for direct dipping, some professional nail technicians currently use a sprinkle or pour method, using a small spoon-like tool or a cuticle pusher to sprinkle the powder on top of the client's nail, over a paper towel, a cup or the original jar. When used with a paper towel, this method is ineffective because it tends to waste powder and any leftover powder on the paper towel is thrown away. When used with the original jar, contamination problems still exist. When used with a cup (plastic or glass), this method serves to reduce wastage of dip powder, but it is very inconvenient because there is no place to rest the client's finger, requiring the professional manicurist to hold and guide the client's hand. Moreover, this technique requires the professional manicurist to have and use multiple cups to avoid mixing different colors of dip powder.

Accordingly, there is a need for an apparatus and method for application of dip powder in a way that reduces unsanitary contamination of the powder by direct dipping of multiple client's fingers into an original dip powder jar, reduces dip powder that is wasted when it is portioned for individual clients, and avoids the use of cheap disposable plastic cups and paper towels for the process.

SUMMARY OF THE INVENTION

Embodiments of the present invention relate to a nail powder application and recycling apparatus and method of use.

DETAILED DESCRIPTION OF THE EMBODIMENTS

Figure 1:
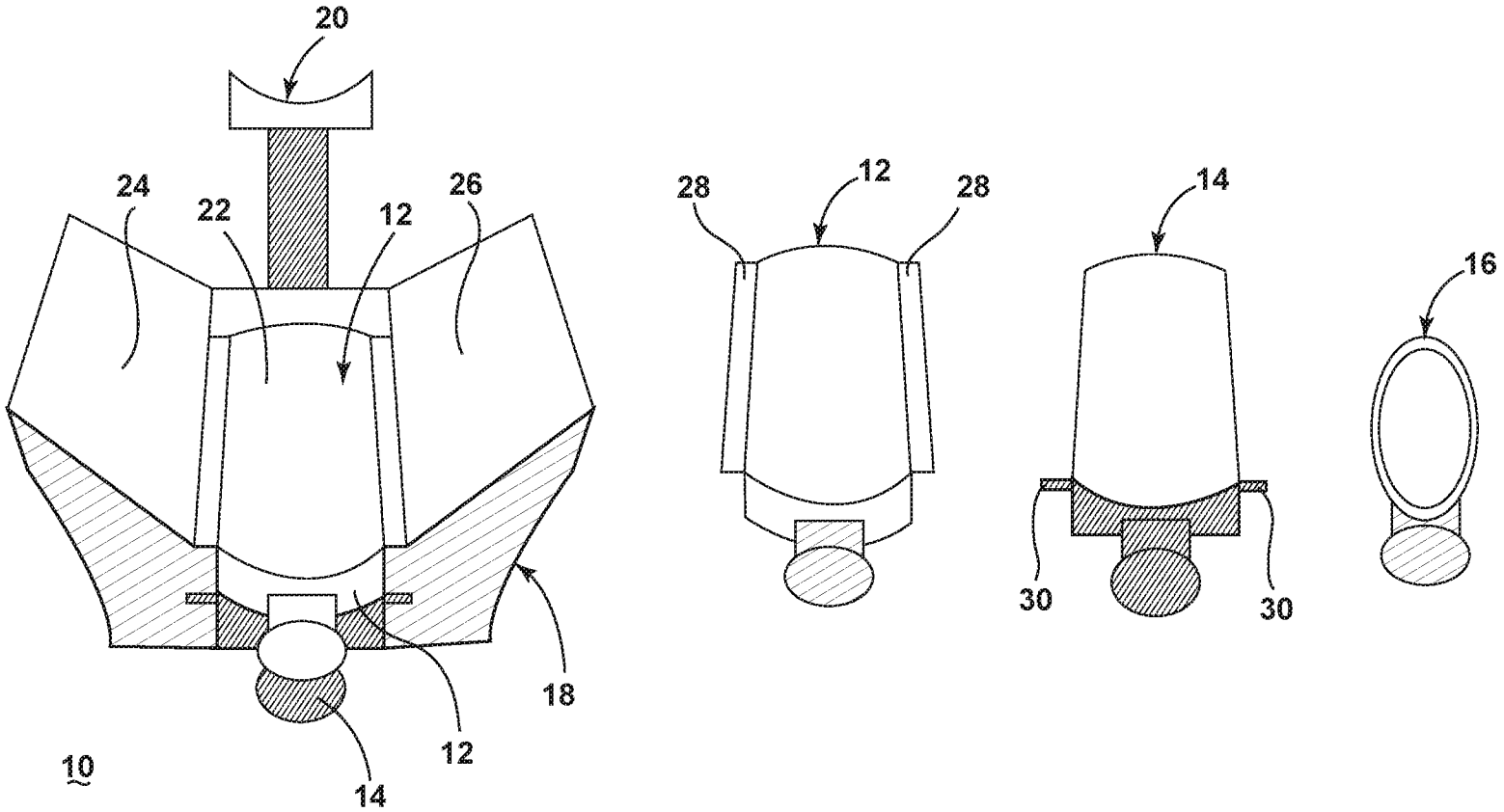
FIG. 1 illustrates a perspective view of an embodiment of the nail powder application and recycling system, with certain moveable components shown both in combination and separated for purposes of explanation.

One embodiment of a dip powder application and recycling apparatus 10 is illustrated in FIG. 1. Other forms of powder, such as but not limited to glitter, may also be applied to a client's nails in accordance with embodiments of the invention discussed below. As shown, the apparatus 10 is fully assembled and ready for use on the left side of the image, and detail of the removable scoop components 12, 14, are shown on the right, when separated from the base. The apparatus has a base 18, a finger rest 20, a main scoop 16, a removable first fall out scoop 12, and a removable second fall out scoop 14. The main scoop 16 is preferably sized such that a full scoop of dip powder is approximately the right amount of dip powder to use for application of dip powder on one fingernail of a client.

The base 18, in combination with the scoops 12, 14 and slides 24, 26, define a capture area 22 for capture of fallen dip powder and to prevent fallen dip powder from falling on the floor, etc., thereby becoming unusable. The finger rest 20 is generally positioned over the base 18, and more specifically, over the capture area 22, so that when in use, the client's finger will rest in the finger rest 20 and the client's finger will be positioned over the capture area 22. The capture area 22 is for the capture of excess or fallen dip powder, after it has been applied to, and fallen off of the client's fingernail. The capture area 22 may include slides 24, 26 to expand the area of the capture area 22 and to direct excess or fallen dip powder downward to the center of the capture area 22. Rails, curves or other similar structures may be used to accomplish this purpose. When assembled for use, the base 18 includes the removable first fall out scoop 12 and the removable second fall out scoop 14. The removable first fall out scoop 12 and the removable second fall out scoop 14 are removably inserted into the base 18 such that they are positioned generally at the center of the capture area 22. Each of the removable scoops may include tabs 28 or projections 30 that engage with slots or cut-outs in the base 18 that ensure that each removable fall out scoop is properly positioned in the capture area 22 when inserted into the base 18.

Application of dip powder to a client's fingernail or toenail is generally performed in a manner that is similar to or the same as the process described above in the Background, with respect to the application of bonding agent, base, sealant and topcoat. However, for each step at which dip powder is to be applied, rather than using a cup or the original jar to "dip" the client's finger into a quantity of powder, instead, an embodiment of the nail polish powder application and recycling apparatus 10 as shown in FIG. 1 can be used. In use, the professional manicurist positions a client's finger on the finger rest 20, with the fingernail positioned over the capture area 22. The professional manicurist uses the main scoop 16 to scoop up a quantity of dip powder from the original jar or other container. The professional manicurist then uses the main scoop 16 to pour or sprinkle dip powder onto the still-wet fingernail. Some of the dip powder will stick to the fingernail, but some of the dip powder will fall off, into the capture area 22. Preferably, the professional manicurist will also tap or gently shake the client's finger to cause excess dip powder to fall into the capture area 22. If dip powder falls onto either of the slides 24, 26 of the capture area 22, the slides 24, 26 will guide the fallen dip powder downward into the center of the capture area 22. The removable first fall out scoop 12, when inserted in the base 18, is positioned at the center of the capture area 22 and the majority of the fallen dip powder will fall or be guided into the removable first fall out scoop 12 and then become captured dip powder.

For subsequent applications of the same color of dip powder to a client's fingernail, the professional manicurist removes the removable first fall out scoop 12, taking care not to spill the captured dip powder. The professional manicurist then uses the removable first fall out scoop 12 to pour or sprinkle captured dip powder onto the still-wet fingernail. Some of the captured dip powder will stick to the fingernail, but some of the captured dip powder will fall off, into the capture area 22. Preferably, the professional manicurist will also tap or gently shake the client's finger to cause excess captured dip powder to fall into the capture area 22. If dip powder falls onto either of the slides 24, 26 of the capture area, the slides will guide the fallen dip powder downward into the center of the capture area 22. The removable second fall out scoop 14, when inserted in the base 18, is positioned at the center of the capture area 22 and the majority of the fallen captured dip powder will fall or be guided into the removable second fall out scoop 14 and then become twice-captured dip powder. The professional manicurist can then remove the second fall out scoop 14 and replace the removable first fall out scoop 12 in the base 18. The above-described process may be repeated as many times as necessary or desired until the manicure is completed. At the conclusion of the manicure, or when the client wants to change to a different color of powder for a different nail, the professional manicurist should dispose of any remaining captured (or twice-captured, etc.) dip powder and the apparatus 10 should be thoroughly washed and sterilized in anticipation of the next color or client. As will be appreciated by one of ordinary skill in the art, the apparatus 10 and procedure described above will improve the sanitary and hygienic nature of the application of dip powder to a fingernail (or toenail), while reducing wastage of expensive dip powder, and further while avoiding the unsightly and un-luxurious use of disposable plastic restaurant sauce cups for the procedure.

Figure 3:
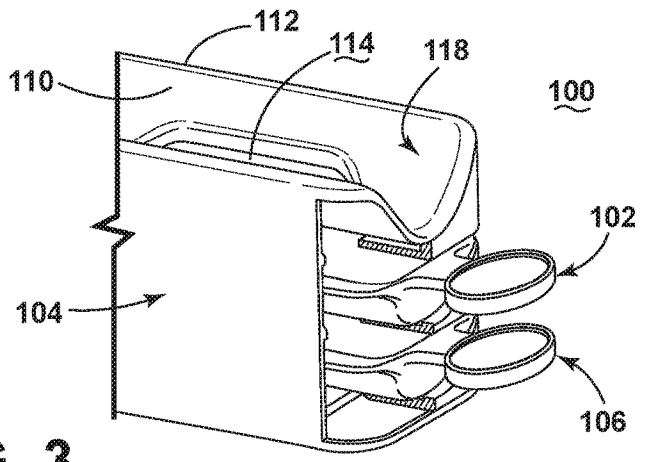
FIG. 3 illustrates a different partial three-quarter perspective view of a portion of the second embodiment of the nail powder application and recycling system with both of the scoops in place within the base, but not showing the removable base cover.
Figure 2:
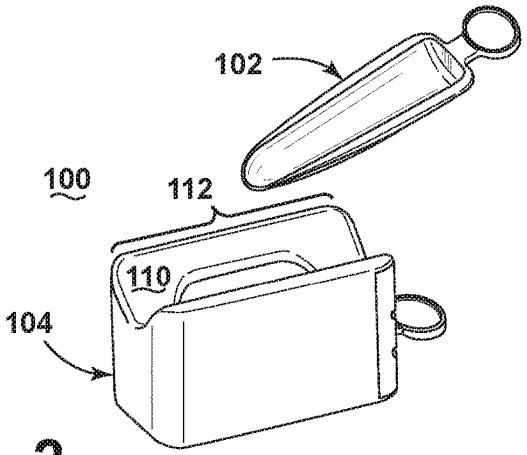
FIG. 2 illustrates a three-quarter perspective view of second embodiment of the nail powder application and recycling system with a recycling scoop removed for purposes of explanation.
Figure 4:
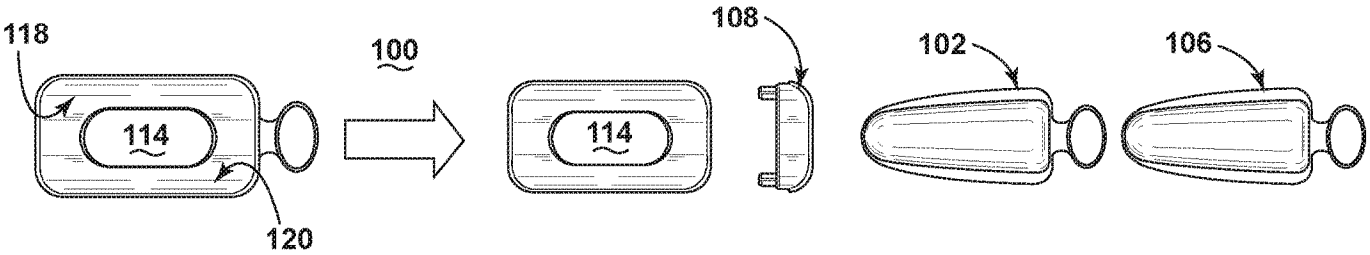
FIG. 4 illustrates a top, deconstructed view of the second embodiment of the nail powder application and recycling system showing, via the arrow, the removable nature of a base cover rest and the scoops from the base.
Figure 5:
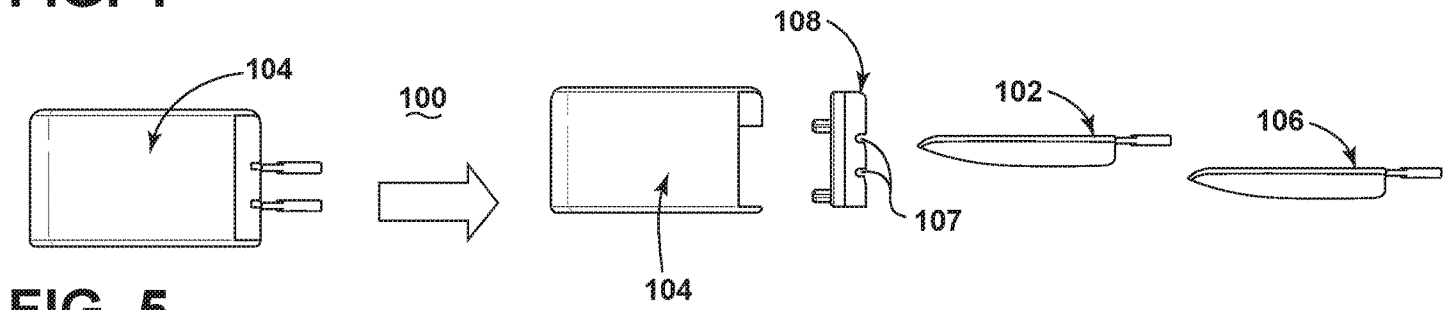
FIG. 5 illustrates a side, deconstructed view of the second embodiment of the nail powder application and recycling system showing, via the arrow, the removable nature of a base cover and the scoops from the base.
Figure 6:
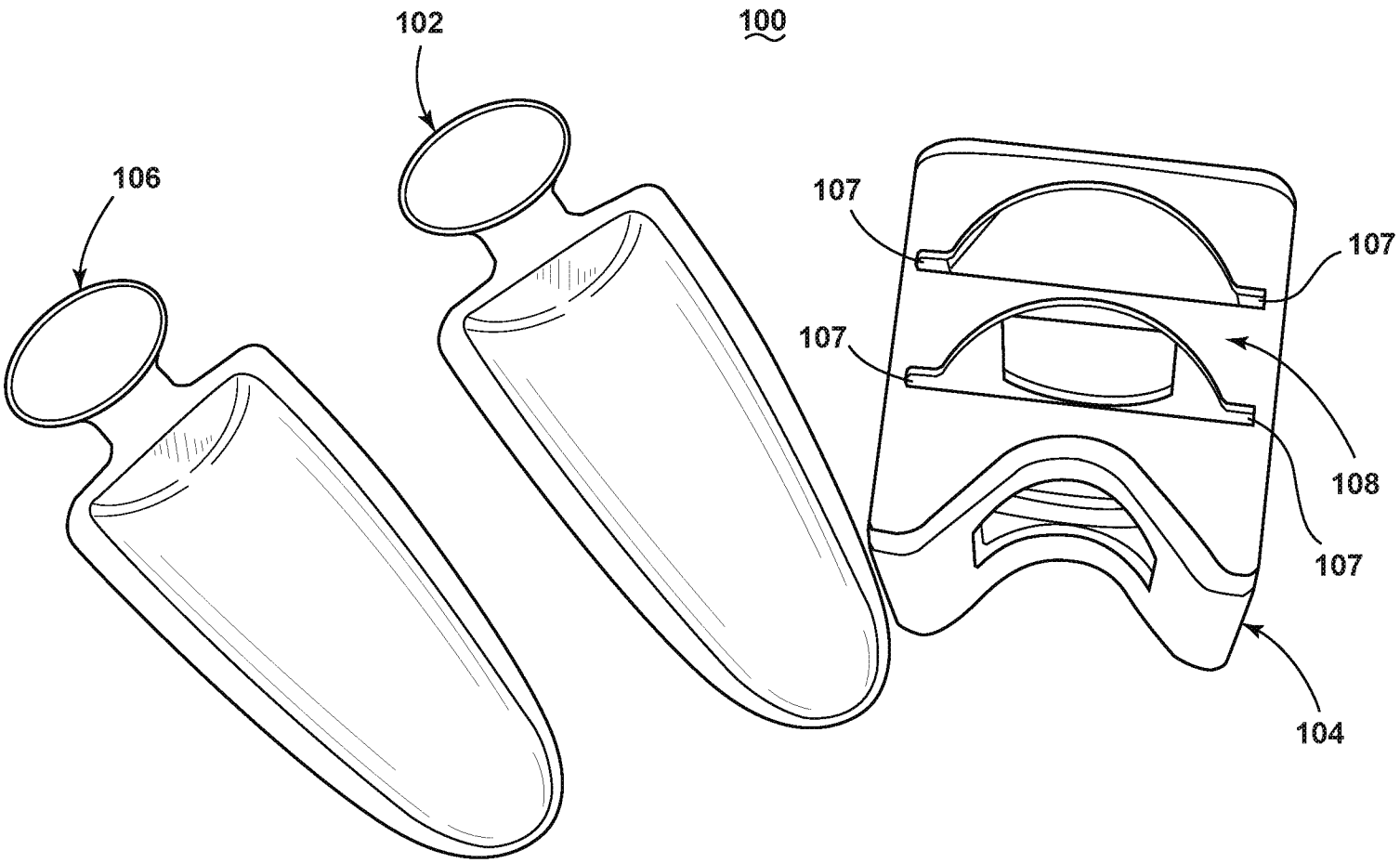
FIG. 6 illustrates another view, of the second embodiment of the nail powder application and recycling system showing the scoops removed, and the end-on view of the base with the slots for the scoops visible.

A second embodiment of a dip powder application and recycling apparatus 100 is illustrated in FIGS. 2-5. In FIG. 2, the apparatus 100 is partially dis-assembled, in that a removable first fall out scoop 102 is out and shown in the pouring position. In FIG. 3, a close-up detail of the apparatus 100 is shown, illustrating the inserted removable scoops, but not showing the removable base closure. In FIG. 4, a top view of a disassembly drawing of the apparatus is shown. In FIG. 5, a side view of a disassembly drawing is shown.

The embodiment shown in FIGS. 2-5 has a base 104, a removable first fall out scoop 102, and a removable second fall out scoop 106. The base 104 also includes a removable base cover 108 that further serves as a guide for insertion and support of the removable scoops. The removable base cover 108 can be removed after use of the apparatus 100 in order to access the interior of the apparatus 100 for cleaning. This embodiment, as well as all others discussed herein, may have a no-slip coating or adhesive on the bottom of the base 104, to prevent the apparatus 10, 100 from moving when in use.

Each of the embodiments discussed herein is generally cleanable in accordance with industry standards. One method of cleaning is to immerse the apparatus 10, 100, in "Barbicide" and then, optionally, put the apparatus 10, 100 into a steam sterilizer disinfection cabinet. "Barbicide" is a trademark of King Research, Inc., a Wisconsin corporation, and is commonly used by barbers, cosmetologist and manicurists to sterilize their tools. Barbicide is a United States Environmental Protection Agency-approved combination germicide, pseudomonacide, fungicide, and a viricide effective against the HIV-1 virus (AIDS virus), Hepatitis B, and Hepatitis C. Its active ingredient is Alkyl dimethyl benzyl ammonium chloride (5.12% by volume); sodium nitrite and blue dye are also present. Contact can cause irritation to the skin and eyes, and consumption of 50 mL can cause shock and may lead to death if not treated quickly. At one time, several US states legally required barber shops to use Barbicide. Barbicide is sold as a concentrate, which is diluted for use in a 1:32 ratio with water, commonly with each manicurist having a container for treating their own tools. The apparatus 10, 100 may optionally be manually cleaned with a brush or sponge, prior to treatment with Barbicide and/or steam disinfection.

Barbicide and steam disinfection can each exert a damaging or corrosive effect upon plastic tools. Embodiments disclosed herein may be manufactured from any durable material, including metals or durable plastics. In one embodiment, the apparatus 10, 110 are made with stainless steel. To ensure that the apparatus 10, 100, can endure repeated cleanings and sterilizations, some embodiments of the apparatus 10, 100, are made of Acrylonitrile Butadiene Styrene (ABS) with a coating of acrylic ester, or other known acrylates and methacrylates. Other materials which can be used to manufacture and coat the apparatus 10, 100 include, but are not limited to any polymer or plastic that exhibits good resistance to Barbicide and steam disinfection.

An additional beneficial property of the disclosed coatings are that they may make the apparatus slippery and therefore reduce friction and adherence of nail powder to the apparatus, causing the nail powder to more easily and more completely fall into the capture area, thus reducing waste. Moreover, the disclosed coatings also resist staining from the color of the powder.

The base includes a finger rest area 110 and a capture area 112. The finger rest area 110 is generally located at the top level of the base 104, on the opposite side from the removable scoops. The capture area 112 is generally the entire top level of the base 104. The finger rest area 110 may be understood to be a sub-area of the capture area 112. The capture area 112 further includes an aperture defining a drop-through hole 114. When in use, the client's finger will rest in the finger rest area 110 and the client's finger will be positioned over the capture area 112, and more preferably, over the drop-through hole 114. The capture area 112 and the drop-through hole 114 is for the capture of excess or fallen dip powder, after it has been applied to, and fallen off of the client's fingernail. The capture area 112 may include slides 118, 120, including concave slides, to expand the area of the capture area 112 and to direct excess or fallen dip powder downward to the center of the capture area 112 and into and through the drop-through hole 114. Rails, curves or other similar structures may be used to accomplish this purpose. As shown in FIGS. 2-5, when assembled for use, the base 104 includes the removable first fall out scoop 102 and the removable second fall out scoop 106. The removable first fall out scoop 102 and the removable second fall out scoop 106 are removably inserted into the base, via guide slots in the removable base cover 108, such that they are positioned generally below the center of the capture area 112 and underneath the drop-through hole 114. Each of the removable scoops may include tabs or projections that engage with slots 107, cut-outs or guide structures 109 in the base 104 and/or the base cover 108 that ensure that each removable fall out scoop is properly positioned under the drop through hole 114 when inserted into the base 104.

Application of dip powder to a client's fingernail or toenail is generally the same as the process described-above in the Background, with respect to the application of bonding agent, base, sealant and topcoat. However, for each step at which dip powder is to be applied, rather than using a cup or the original jar to "dip" the client's finger into a quantity of powder, instead, an embodiment of the nail polish powder application and recycling apparatus 100 as shown in FIGS. 2-5 can be used. In use, the professional manicurist positions a client's finger on the finger rest area 110, with the fingernail positioned over the capture area 112, and more preferably, over the drop-through hole 114. The professional manicurist uses the removable first scoop 102 to scoop up a quantity of dip powder from the original jar or other container. The professional manicurist then uses the removable first scoop 102 to pour or sprinkle dip powder onto the still-wet fingernail. Some of the dip powder will stick to the fingernail, but some of the dip powder will fall off, into the capture area 112. Preferably, the professional manicurist will also tap or gently shake the client's finger to cause excess dip powder to fall into the capture area 112. If dip powder falls onto either of the slides 118, 120 of the capture area 112, the slides 118, 120 will guide the fallen dip powder downward into the center of the capture area 112. The majority of the fallen dip powder will fall through the drop-through hole 114 at the center of the capture area 112 and downward into the removable second fall out scoop 106 and thus become captured dip powder. The professional manicurist can then re-insert the removable first fall out scoop 102.

For subsequent applications of the same color of dip powder to a client's fingernail, the professional manicurist removes the removable second fall out scoop 106, taking care not to spill the captured dip powder. The professional manicurist then uses the removable second fall out scoop 106 to pour or sprinkle captured dip powder onto the still-wet fingernail. Some of the captured dip powder will stick to the fingernail, but some of the captured dip powder will fall off, into the capture area 112. Preferably, the professional manicurist will also tap or gently shake the client's finger to cause excess captured dip powder to fall into the capture area 112. If dip powder falls onto either of the slides of the capture area 112, the slides 118, 120 will guide the fallen captured dip powder downward into the center of the capture area 112. The majority of the fallen captured dip powder that falls to the center of the capture area 112 will fall through the drop-through hole 114, and into the in-place removable first fall out scoop 102, and thus become twice-captured dip powder. The professional manicurist can then replace the removable second fall out scoop 106 in the base 104. The above-described process may be repeated as many times as necessary or desired until the manicure is completed. At the conclusion of the manicure, or when the client wants to change to a different color of powder for a different nail, the professional manicurist should dispose of any remaining captured (or twice-captured, etc.) dip powder and the apparatus 100 should be thoroughly washed and sanitized, in anticipation of the next color or client. The washing and sanitizing is promoted by this embodiment, in that the removable base cover 108 can be removed in order to allow cleaning agents to reach the inside of the base 104. As will be appreciated by one of ordinary skill in the art, the apparatus and procedure described above will improve the sanitary and hygienic nature of the application of dip powder to a fingernail (or toenail), while reducing wastage of expensive dip powder, and further while avoiding the unsightly and un-luxurious use of disposable plastic restaurant sauce cups for the procedure.

Figure 7:
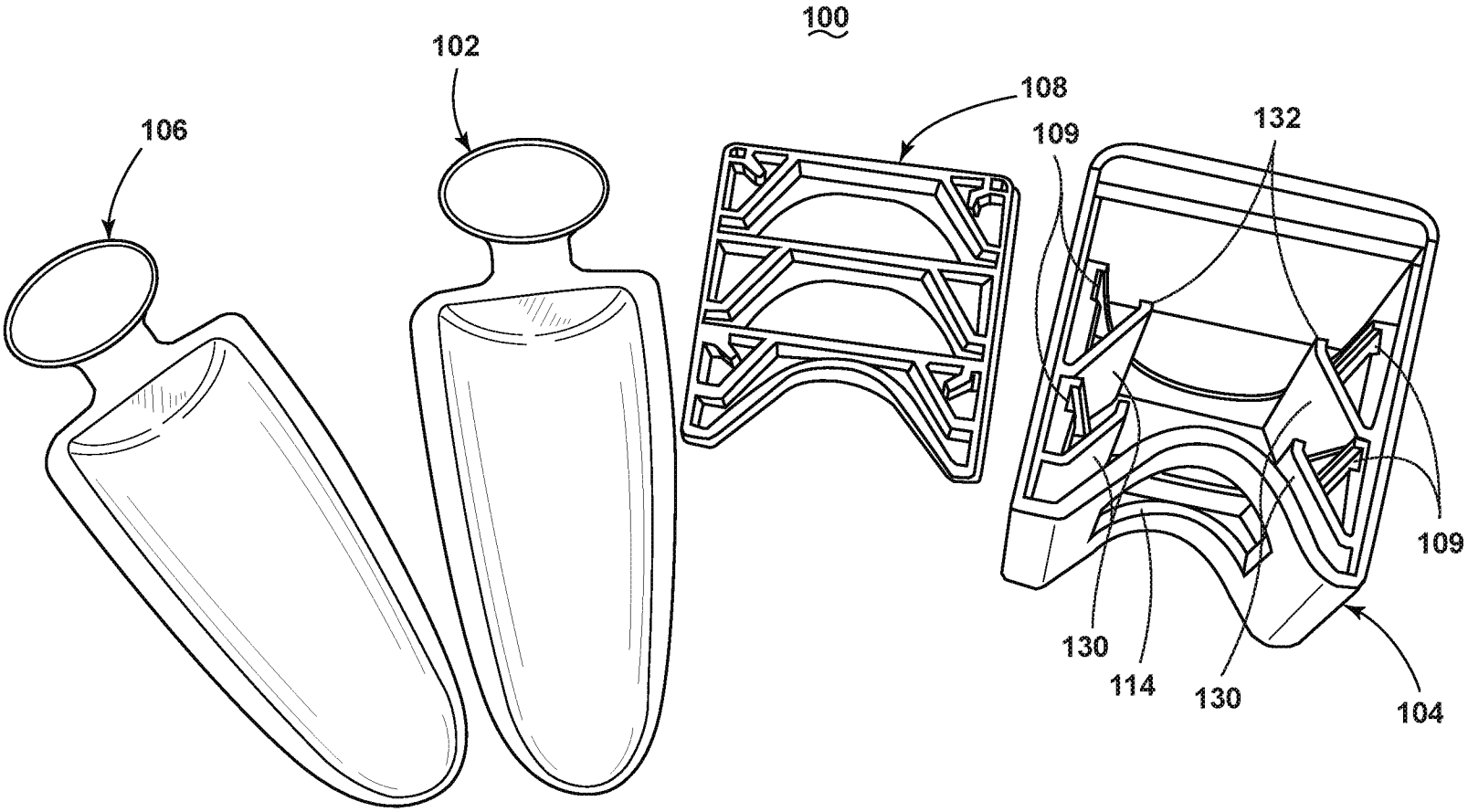
FIG. 7 illustrates another view, of the second embodiment of the nail powder application and recycling system showing the scoops removed, and the end-on view of the base, with the base closure removed, so that the interior of the base, and the interior of the base closure, is visible.

An embodiment of a dip powder application and recycling apparatus, and the use thereof, is illustrated in FIGS. 6-15. Of additional interest. FIG. 7 provides a view of the interior of the base 104 and the interior of the removable base cover 108 when the apparatus 100 is disassembled. The interior of the base 104 includes one or more internal slides 130 projecting from the walls of the base inwardly and downwardly away from the drop through hole 114. Each of the one or more internal slides 130 is aligned with the drop-through hole 114 of the capture area 112, such that, when fallen dip powder falls through the drop-through hole 114, if it falls onto one of the internal slides 130, it is guided inwardly and downwardly toward the center of the apparatus and into one of the two removable fall out scoops, when the scoops are in place. Preferably, the inside edge 132 of each of the internal slides 130 is laterally inward of the outside edge of each of the removable scoops when in place (not shown).

FIGS. 8-15 show steps in the use of the described apparatus to apply dip powder to a client's fingernail.

Figure 8:
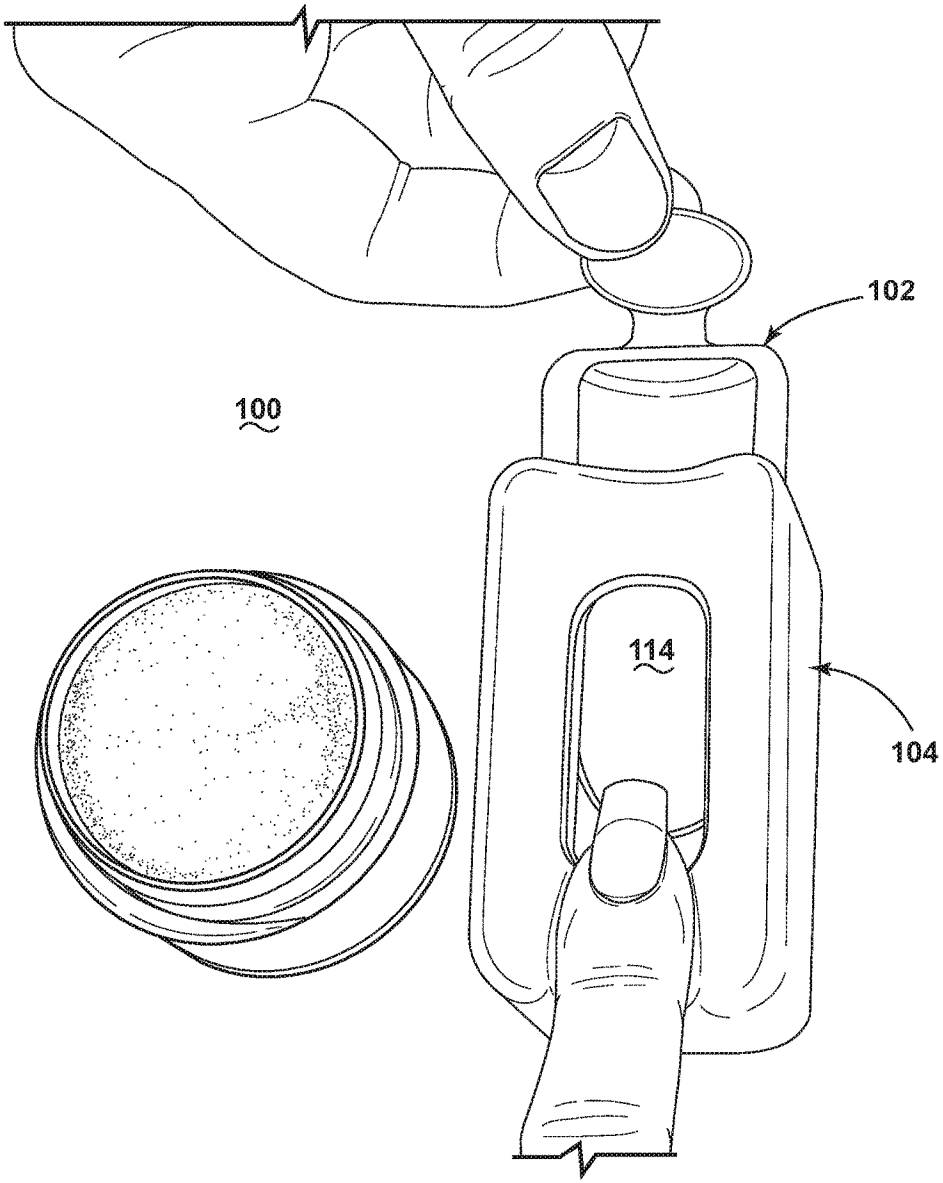
FIG. 8 illustrates a top view, of the second embodiment of the nail powder application and recycling system, in use, with the client's finger on the finger rest and the finger nail generally over the base's drop-through hole and with the professional manicurist removing the first scoop.

In FIG. 8, the nail powder application and recycling system is ready for use. A client's finger is placed in the finger rest area 110, with the client's finger nail generally over the capture area 112 and the drop-through hole 114. The professional manicurist is removing the removable first scoop 102, while the removable second scoop 106 is in place, though not shown in this view.

Figure 9:
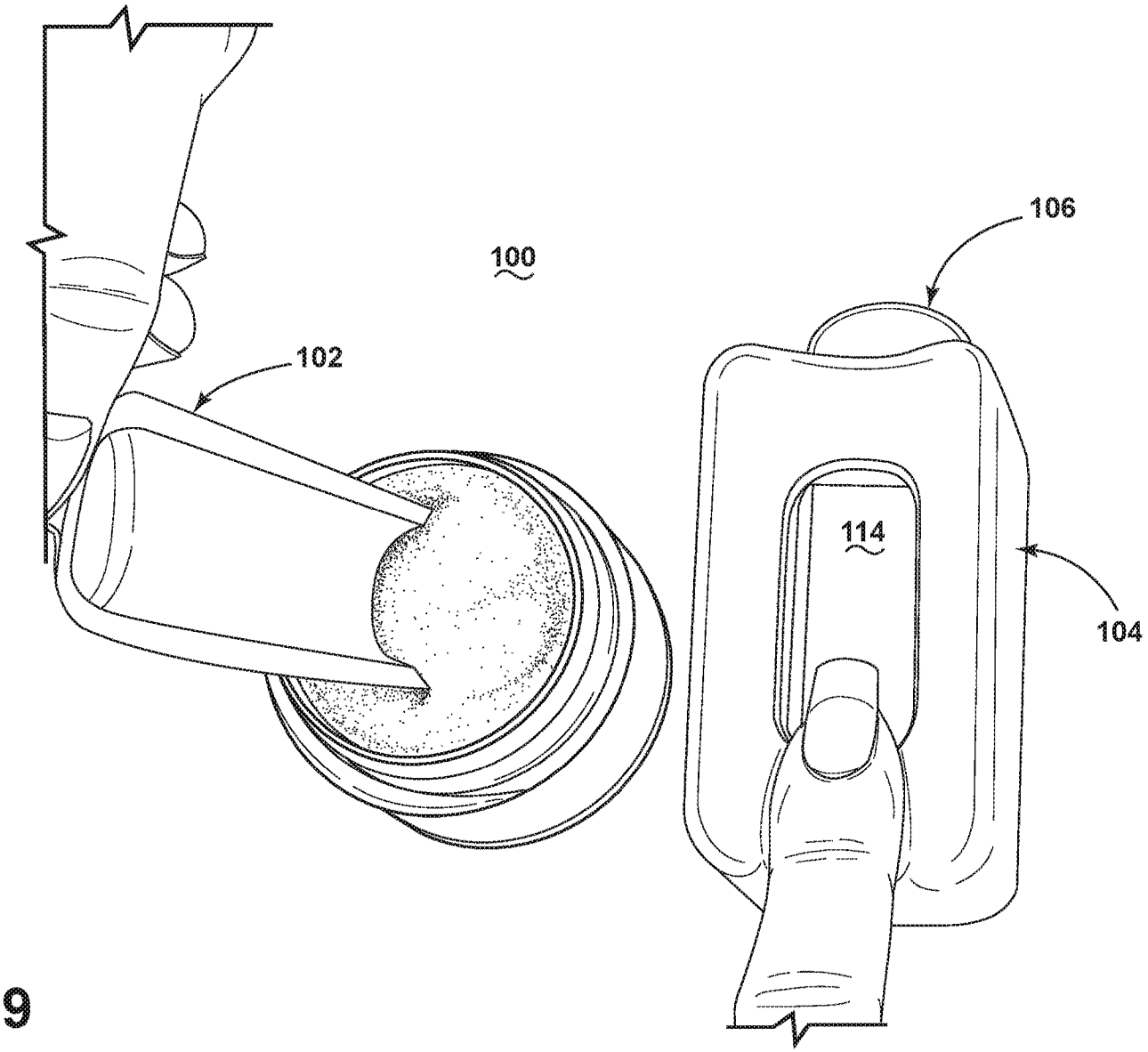
FIG. 9 illustrates a top view, of the second embodiment of the nail powder application and recycling system, in use, with the client's finger on the finger rest and the finger nail generally over the base's drop-through hole and with the professional manicurist using the first scoop to scoop a quantity of dip powder from an original jar.

In FIG. 9, with the client's finger nail positioned generally over the base 104 capture area 112 drop-through hole 114, the professional manicurist is using the removable first scoop 102 to scoop a quantity of dip powder from an original jar.

Figure 10:
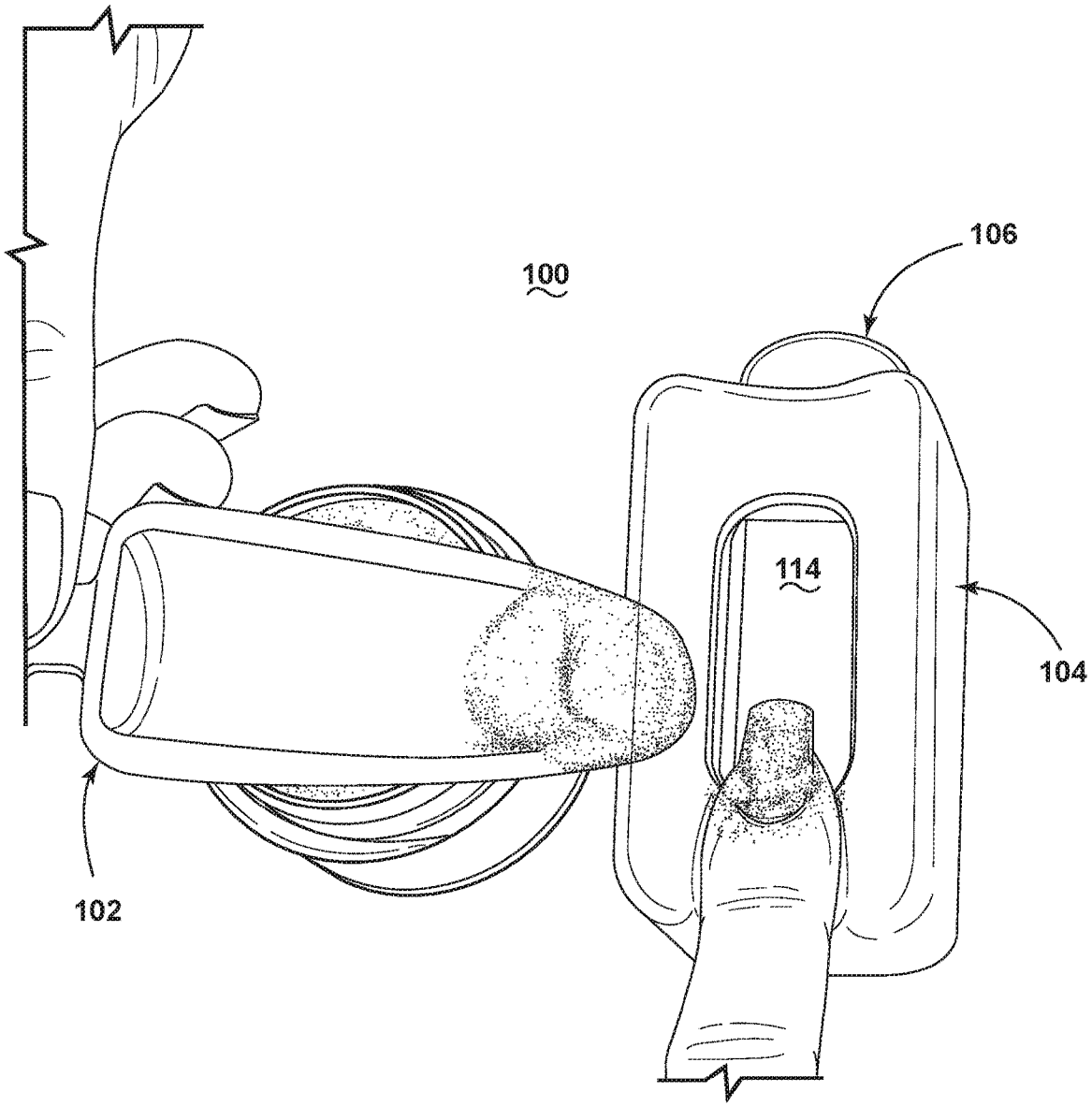
FIG. 10 illustrates a top view, of the second embodiment of the nail powder application and recycling system of the present invention, in use, with the client's finger nail generally over the base's drop-through hole and with the professional manicurist using the first scoop to pour dip powder onto the client's finger nail.

In FIG. 10, with the client's finger nail positioned generally over the base capture area drop-through hole 114, the professional manicurist is using the removable first scoop 102 to pour dip powder onto the client's finger nail.

Figure 11:
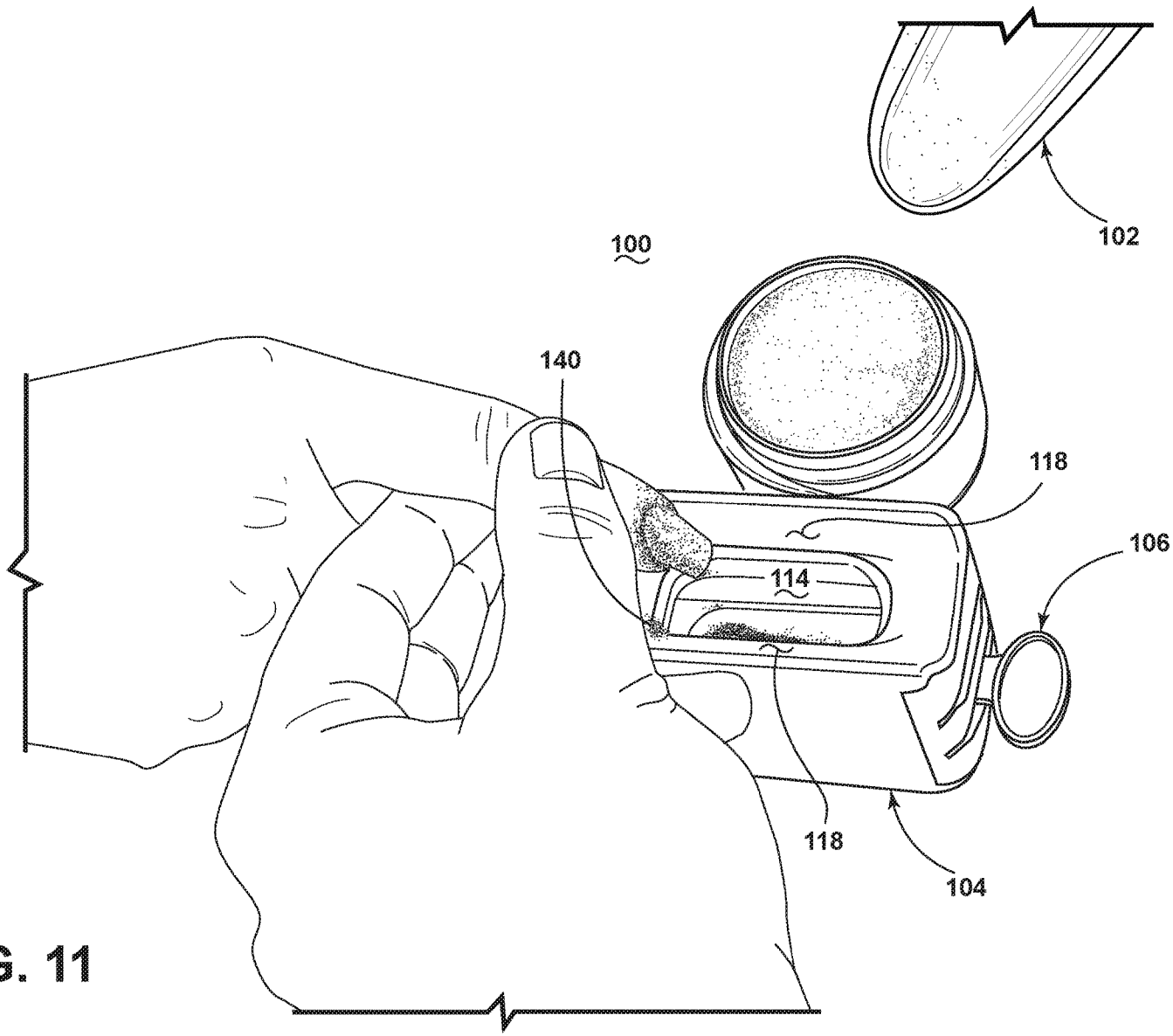
FIG. 11 illustrates a top perspective view, of the second embodiment of the nail powder application and recycling system, in use, with the client's finger nail generally over the base's drop-through hole, with an excess of dip powder on the client's finger nail, the first scoop removed, and the professional manicurist tapping the client's finger to cause the excess to fall through the drop-through hole and into the second scoop.

In FIG. 11, with the client's finger nail generally over the base's drop-through hole 114 and with an excess of dip powder on the client's finger nail, and the removable first scoop 102 removed, the professional manicurist is tapping the client's finger to cause the excess dip powder to fall through the drop-through hole 114 and into the removable second scoop 106 and thus become captured dip powder. It can also be seen that some of the fallen dip powder 140 has landed on one of the slides 118 of the capture area and has mostly fallen through, but has left a small residue of powder on the slide 118. This can be shaken or brushed through the drop-through hole 114.

Figure 12:
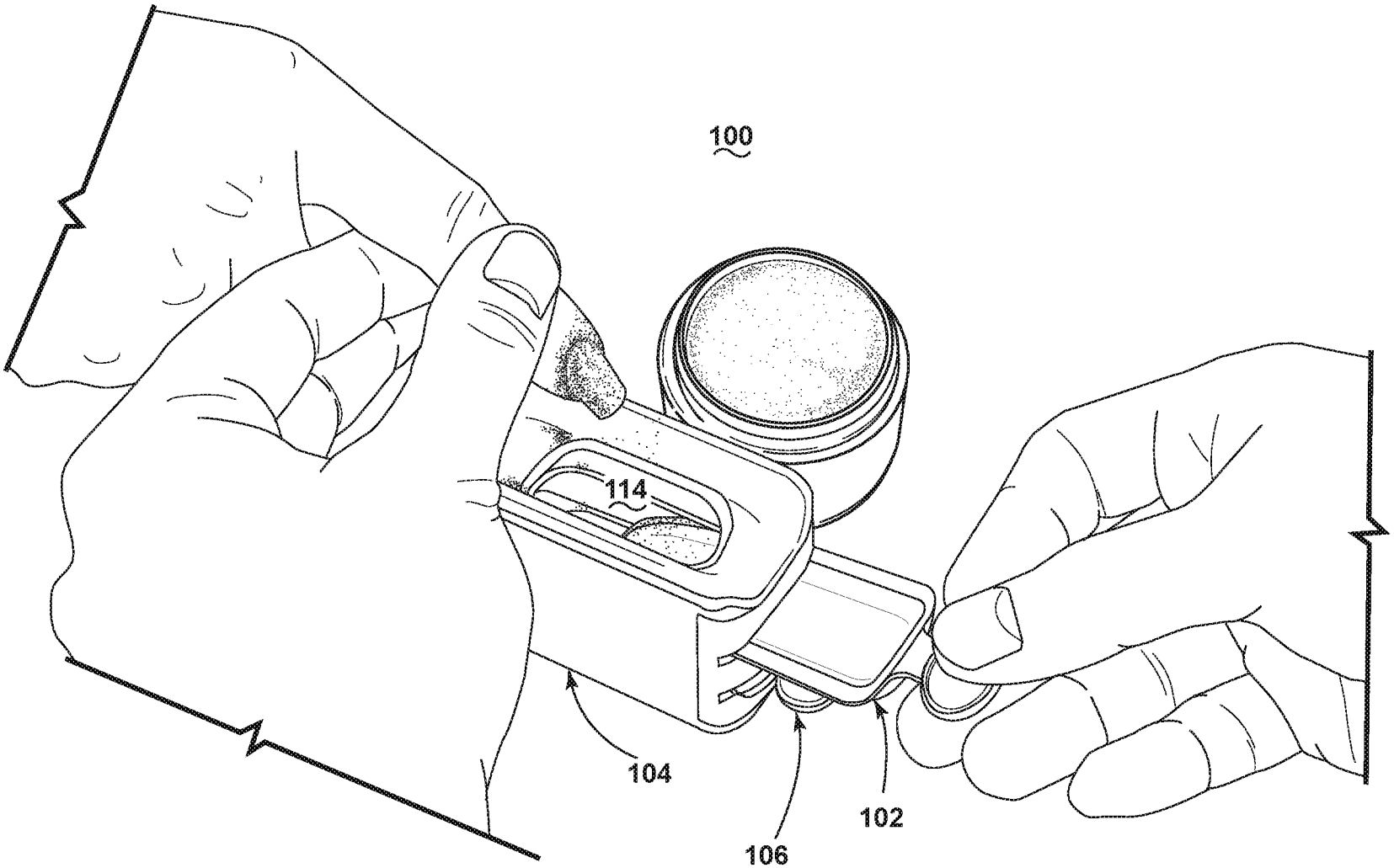
FIG. 12 illustrates a top perspective view, of the second embodiment of the nail powder application and recycling system, in use, with the client's finger nail generally over the base's drop-through hole and with the professional manicurist replacing the first scoop.

In FIG. 12, with the client's finger nail generally over the base drop-through hole 114, the professional manicurist is replacing the empty removable first scoop 102.

Next, with both of the removable fall through scoops in place, the professional manicurist is performs an application of a liquid coating, such as base, to the client's fingernail (not shown).

Figure 13:
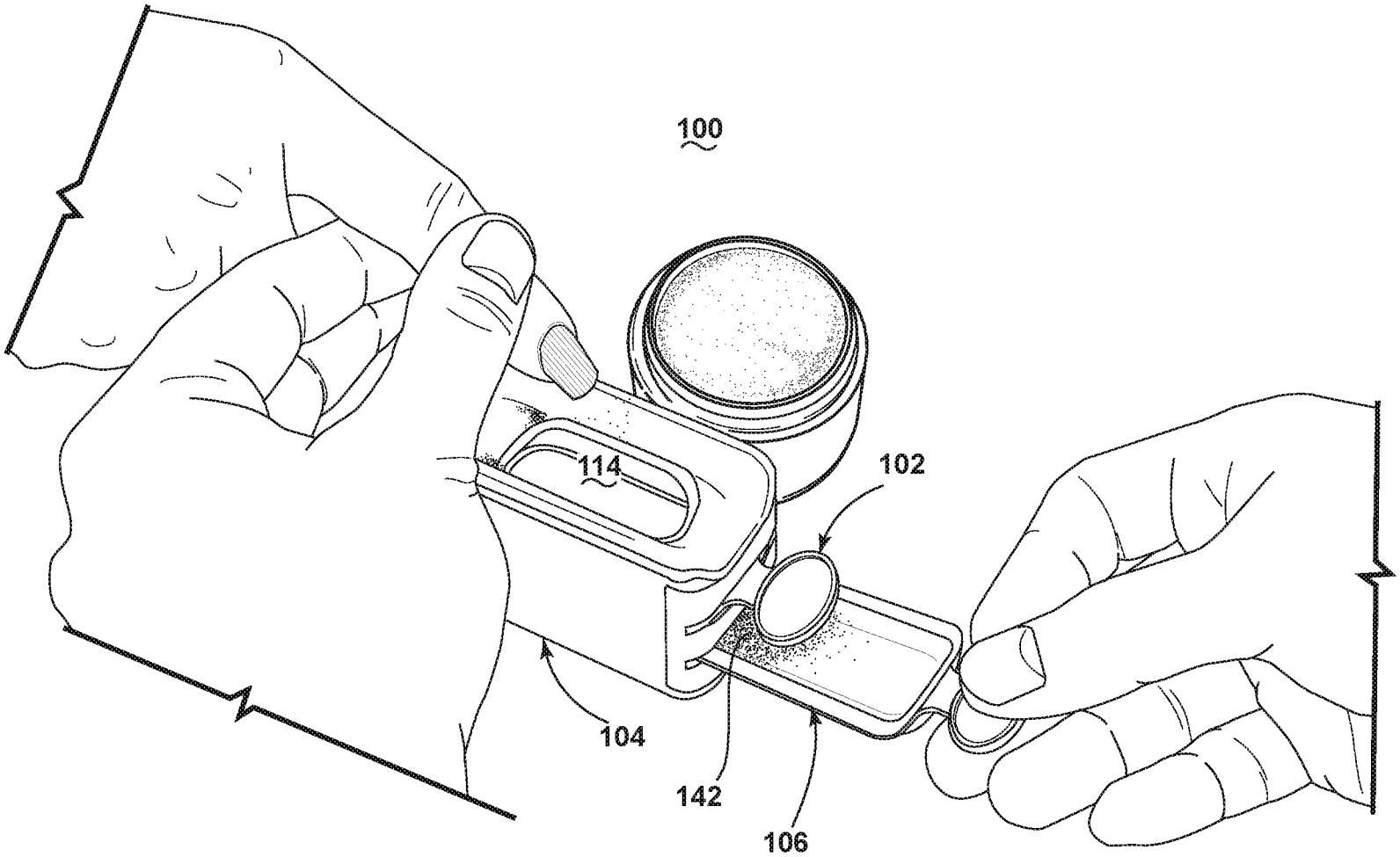
FIG. 13 illustrates a top perspective view, of the second embodiment of the nail powder application and recycling system, in use, with the professional manicurist holding the client's finger that has a still-wet fingernail, and removing the second scoop containing fallen-and-captured dip powder.

In FIG. 13, with the professional manicurist holding the client's finger that has a still-wet fingernail, the professional manicurist is removing the removable second scoop 106 containing fallen-and-captured dip powder 142 and preparing to pour the fallen and captured dip powder 142 onto the client's still-wet finger nail.

Figure 14:
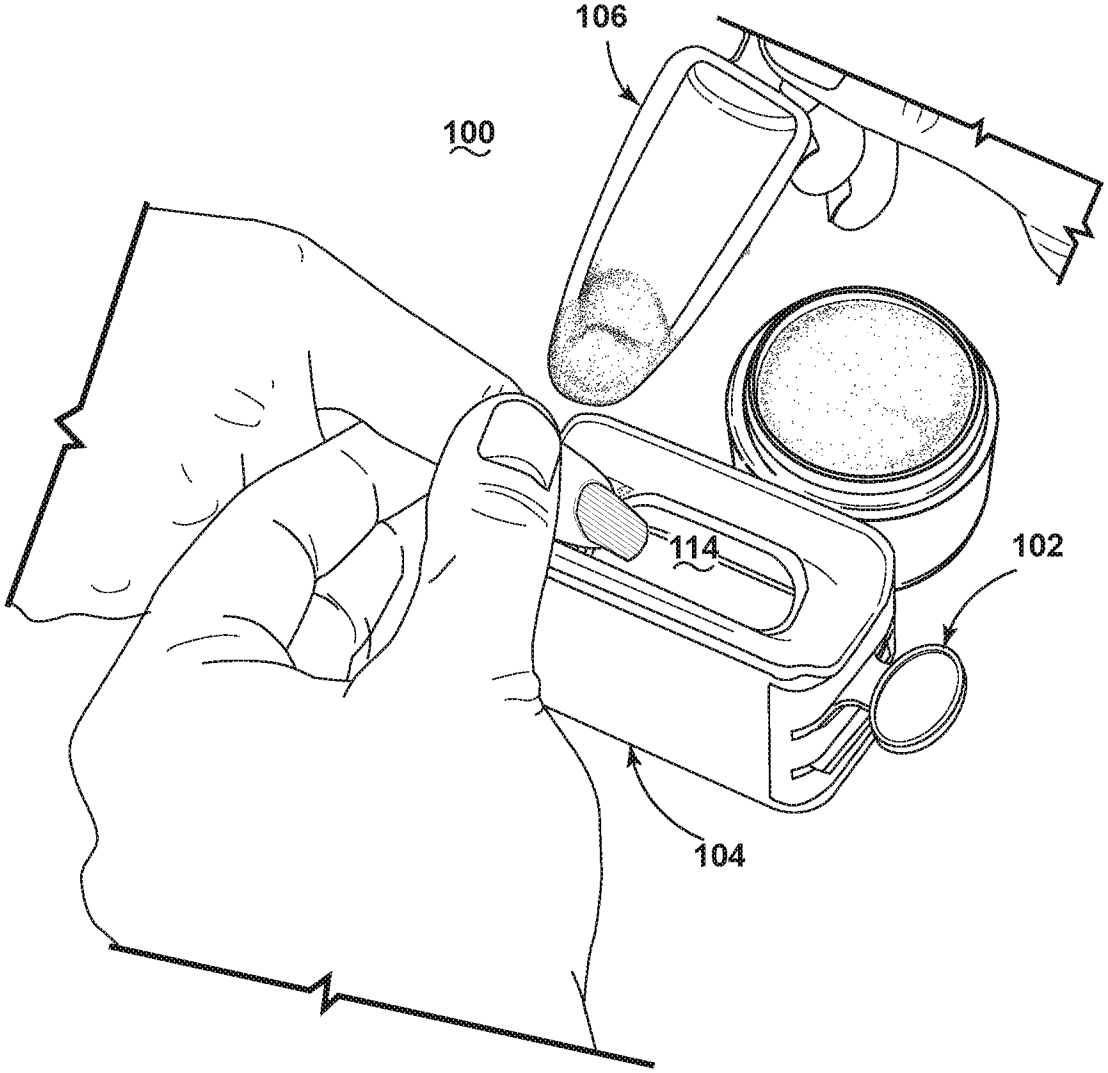
FIG. 14 illustrates a top perspective view, of the second embodiment of the nail powder application and recycling system, in use, with the client's finger on the finger rest and the finger nail generally over the base's drop-through hole, with the first scoop in place, and with the professional manicurist beginning to pour the fallen-and-captured dip powder from the second scoop onto the client's fingernail.

In FIG. 14, with the client's finger nail generally over the base capture area drop-through hole 114, with the removable first scoop 102 in place, the professional manicurist begins to pour the fallen-and-captured dip powder 142 from the second scoop 106 onto the client's fingernail.

Figure 15:
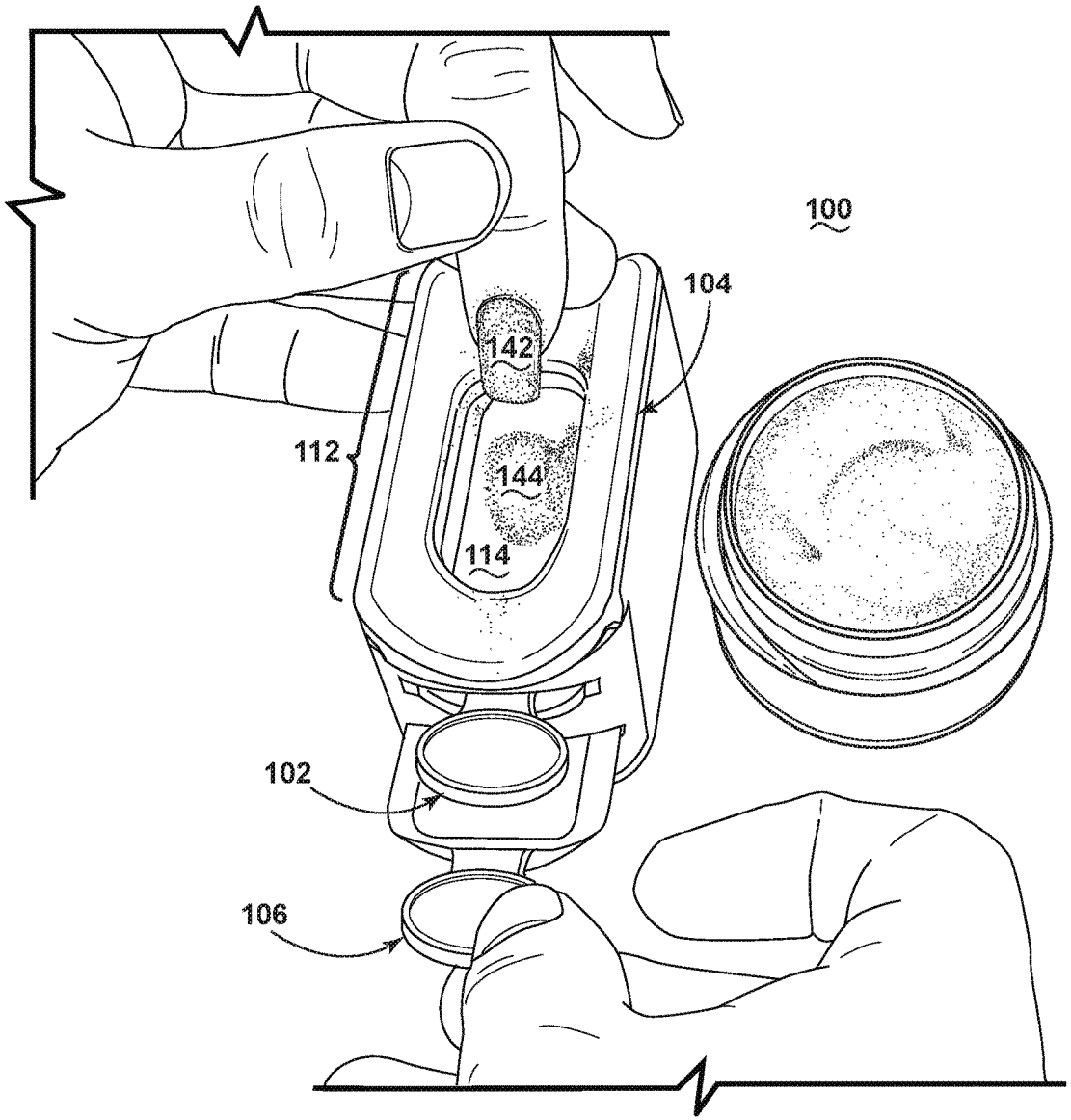
FIG. 15 illustrates a top front perspective view, of the second embodiment of the nail powder application and recycling system, in use, with the client's finger held by the professional manicurist generally over the base's drop-through hole and covered with dip powder, an excess of dip powder fallen through the drop-through hole and captured in the first scoop, and with the professional manicurist replacing the second scoop.

In FIG. 15, the client's finger is held by the professional manicurist generally over the base capture area drop-through hole 114. The client's finger nail is covered with captured dip powder and an excess of captured dip powder has fallen through the drop-through hole 114 and become twice-captured dip powder 144 in the removable first scoop 102. The professional manicurist is also replacing the removable second fall through scoop in the base. The application of dip powder, using this same general procedure may be continued for as many applications as needed. When complete, any remaining captured dip powder should be disposed. The apparatus 100 should be washed and sterilized to destroy germs and contaminants, and to remove any remaining dip powder, in anticipation of a next client.

Although specific embodiments of the invention have been disclosed, those having ordinary skill in the art will understand that changes can be made to the specific embodiments without departing from the spirit and scope of the invention. The scope of the invention is not to be restricted, therefore, to the specific embodiments disclosed.

What is claimed is:

1. A nail powder application and recycling apparatus for applying dry nail powder to a finger nail and capturing fallen dry nail powder from the application process, comprising:

a base, wherein the base extends from a top surface to a bottom surface, the base further comprising a capture area defined by a recessed portion in the top surface of the base that extends into the base toward the bottom surface;

a finger rest aligned with the base, whereby the finger rest will position the fingernail over the capture area; and a first removable scoop placement area located within the base between the top and bottom surfaces;

a first removable scoop removably located within the first scoop placement area, wherein when placed, the first removable scoop is configured to be below the fingernail when the fingernail is positioned on the finger rest;

wherein the base further comprises:

a first slide projecting outwardly from the capture area;

wherein the first slide is angled inwardly and downwardly relative to the base, whereby the first slide will direct fallen dry nail powder from an application process into the first scoop placement area within the capture area, and thereby into the first removable scoop when the first removable scoop is positioned in the first scoop placement area;

and a second removable scoop configured to be seated directly below the first removable scoop.

2. The nail powder application and recycling apparatus of claim 1, wherein the base is configured to define a second scoop placement area within the capture area below the first scoop placement area such that when the first removable scoop is placed within the first scoop placement area and the second removable scoop is placed within the second scoop placement area, the first scoop removable scoop is located above the second removable scoop within the capture area.

3. The nail powder application and recycling apparatus of claim 2, wherein the second removable scoop further comprises a second removable scoop side tab and wherein when the second removable scoop is positioned in the second scoop placement area, the second removable scoop side tab engages the base to correctly position the second removable scoop generally in the center of the capture area and below the first scoop placement area.

4. The nail powder application and recycling apparatus of claim 2, wherein the first removable scoop further comprises a first removable scoop side tab and wherein when the first removable scoop is positioned in the first scoop placement area in the capture area, the first removable scoop side tab engages the base to correctly position the first removable scoop generally in the center of the capture area and above the second scoop placement area.

5. The nail powder application and recycling apparatus of claim 1, wherein the first removable scoop comprises a scoop portion, a handle and a side tab.

6. The nail powder application and recycling apparatus of claim 1, wherein the finger rest comprises a curved profile.

7. The nail powder application and recycling apparatus of claim 1, wherein the finger rest is integral with the base.

8. The nail powder application and recycling apparatus of claim 1 wherein the finger rest projects upwardly from the base.

9. The nail powder application and recycling apparatus of claim 1, wherein the finger rest is removable.

10. The nail powder application and recycling apparatus of claim 1, wherein the nail powder application and recycling apparatus comprises Acrylonitrile Butadiene Styrene (ABS).

11. The nail powder application and recycling apparatus of claim 1, wherein at least a portion of the base includes a coating of acrylate.

12. A nail powder application and recycling apparatus for applying dry nail powder to a finger nail and capturing fallen dry nail powder from the application process, comprising:

a base, wherein the base comprises:

a top surface and a spaced apart bottom surface, the top surface comprising an aperture extending therethrough defining a capture area within the base between the top and bottom surfaces;

a finger rest;

wherein the finger rest positions the finger nail over the aperture;

a first removable scoop; and a second removable scoop;

wherein the base is defines a first scoop placement area within the capture area and under the aperture, and a second scoop placement area under the first scoop placement area and above the bottom surface of the base such that the first removable scoop is positionable in the first scoop placement area; and the second removable scoop is positionable in the second scoop placement area below the first removable scoop.

13. The nail powder application and recycling apparatus of claim 12, further comprising:

a removable base cover removably attachable to a side of the base between the top and bottom surfaces;

wherein the removable base cover comprises a first slot and a second slot;

wherein the second slot is below the first slot such that when the first removable scoop is positioned in the first scoop placement area the first scoop is inserted into the first slot; and when the second removable scoop is positioned in the second scoop placement area the second removable scoop is inserted into the second slot.

14. The nail powder application and recycling apparatus of claim 12, wherein the top surface of the base is angled inwardly and downwardly toward the aperture, whereby the top surface of the base will direct fallen nail powder from the application process into the aperture.

15. The nail powder application and recycling apparatus of claim 14, wherein the top surface is angled such that opposing sides of the aperture are both angled inwardly and downwardly such that the top surface will direct fallen nail powder from the application process into the aperture.

16. The nail powder application and recycling apparatus of claim 12, wherein the base further comprises an internal slide positioned below the aperture, projecting inwardly relative to a center of the capture area, and projecting downwardly relative to the top surface, whereby the internal slide will direct fallen nail powder from the application process into one of the first removable scoop or the second removable scoop.

17. The nail powder application and recycling apparatus of claim 12, wherein the finger rest comprises a curved profile.

18. The nail powder application and recycling apparatus of claim 12, wherein the finger rest is integral with the base.

19. The nail powder application and recycling apparatus of claim 12, wherein the nail powder application and recycling apparatus comprises Acrylonitrile Butadiene Styrene (ABS).

20. The nail powder application and recycling apparatus of claim 12, wherein the base comprises stainless steel.

21. The nail powder application and recycling apparatus of claim 12, wherein at least a portion of the base includes a coating of acrylate.

22. A nail powder application and recycling apparatus comprising:

a base, wherein the base extends from a top surface to a bottom surface, the base further comprising a capture area defined by space between the top surface of the base and the bottom surface;

an aperture extending through the top surface of the base;

a first removable scoop placement area within the capture area under the aperture;

a second scoop placement area located between the first scoop placement area and the bottom surface of the base;

a first removable scoop;

a second removable scoop;

wherein the first removable scoop is configured to be seated within the first removable scoop placement area while the second removable scoop is configured to be seated within the second removable scoop placement area;

a removable base cover removably attachable to a side of the base between the top and bottom surfaces;

wherein the removable base cover comprises a first slot and a second slot below the first slot such that when the first removable scoop is positioned in the first removable scoop placement area the first scoop is inserted into the first slot; and when the second removable scoop is positioned in the second removable scoop placement area the second removable scoop is inserted into the second slot;

wherein the top surface further comprises:

a first slide portion projecting outwardly from the aperture;

a second slide portion projecting outwardly from the aperture;

wherein the first slide and the second slide are angled inwardly and downwardly toward the aperture, whereby the first slide and the second slide will direct fallen nail powder from the application process into the aperture;

wherein the base further comprises an internal slide projecting inwardly relative to a center of the capture area, and downwardly relative to the aperture, whereby the first slide and the internal slide will each direct fallen nail powder from the application process into one of the first scoop placement area and the first removable scoop, when the first removable scoop is positioned in the first scoop placement area, or into the second scoop placement area and the second removable scoop, when the second removable scoop is positioned in the second scoop placement area if the first removable scoop is not positioned in the first scoop placement area.

* * * * *